United States Patent [19]

Watisse et al.

[11] Patent Number: 5,058,399

[45] Date of Patent: Oct. 22, 1991

[54] CHAIN KNITTED FABRIC WITH A PLUSHED LOOP ON BOTH SIDES AND ITS PRODUCTION METHOD

[75] Inventors: Luc Watisse, St. Quentin; Christian Plaskowski, Urvillers; Jean-Francois Forest, St. Quentin, all of France

[73] Assignee: Le Textile Delcer, France

[21] Appl. No.: 411,858

[22] Filed: Sep. 25, 1989

[30] Foreign Application Priority Data

Sep. 27, 1988 [FR] France ..... 88 13057

[51] Int. Cl.[5] ..... D04B 21/02

[52] U.S. Cl. ..... 66/203; 66/194

[58] Field of Search ..... 66/191, 194, 203

[56] References Cited

U.S. PATENT DOCUMENTS 4,712,281 12/1987 Scheller ..... 66/194 X
4,773,135 9/1988 Sato et al. ..... 66/194 X

FOREIGN PATENT DOCUMENTS 3047059 7/1982 Fed. Rep. of Germany ..... 66/194
6046579 10/1986 Japan ..... 66/194

OTHER PUBLICATIONS

Rogler-Humboldt: Die Kettenwirkerei (Bindungslehre Textilingenieur) Max Von Rogler und Martin Humboldt Fruhjahr 1955.

Tricot Brushed Velour Fabrics; (Knitted Outerwear Times); K. D. Darlington, vol. 38 No. 23 pp. 43–47 6–1969.

Knitted Velour: A Primer (Knitted Outerwear Times); Charles Reichman, pp. 25–29 1–1970.

*Primary Examiner*—Werner H. Schroeder
*Assistant Examiner*—John J. Calvert
*Attorney, Agent, or Firm*—Ladas & Parry

[57] ABSTRACT

Method for producing chain knitted fabric and cloth of the same with ratined aspect comprises the steps of embodying fabric on a loom having at least two guide bars, feeding more yield of yarn for forming plushed loop effect up to 40 to 50% greater than normal yield thereof without forming plushed loop, and yield of a foundation yarn up to 4 to 6% more than the normal yield, and adjusting the loom so that the yarn alternately and irregularly loops on the right and wrong sides of the knitted fabric. The adjustment includes, for example, increases of crocheting and the hemming depth.

9 Claims, 1 Drawing Sheet

CHAIN KNITTED FABRIC WITH A PLUSHED LOOP ON BOTH SIDES AND ITS PRODUCTION METHOD

FIELD OF THE INVENTION

The present invention concerns knitted fabrics with cast stitches known as "chain" knitted fabrics, whose stitches formed by a given thread or yarn do not belong to a given row. More particularly, it concerns chain knitted fabrics presenting on both sides, namely the right and wrong sides, a plush loop effect.

BACKGROUND OF THE INVENTION

Knitted fabrics with cast stitches are produced on looms known as "chain looms", or on looms called "Rachel" looms. The present invention involves knitted fabrics on chain looms.

The presence of a yarn giving a plushed loop effect o on both sides of the knitted ,fabric,.is well-known to specialists in this field and to those who are familiar with the various modes for obtaining these, either owing to the conception of the loom itself, or via the adequate adjustment of loom devices.

As regards stitch knitted fabrics of this type, the claimant is aware that the plushed loop effects on both sides are embodied by at least two separate yarns, that is, mounted on two bars with different broaches

SUMMARY OF THE INVENTION

Now a chain knitted fabric has been discovered. Said fabric is the subject of the invention, which is of a known type comprising a plushed loop on the two sides, but is characterized in that the plushed loops are obtained irregularly at the time of knitting by the same yarn.

This special feature of the knitted fabric of the invention is preferably made by emphasizing the irregular plushed loop effects on the two sides by grinding with emery. Accordingly, a further object of the invention is to protect a chain knitted fabric having a ratined aspect on both sides and to comprise on its two sides accumulations of fibers obtained by grinding with emery the plushed loops produced irregularly at the time of knitting by the same yarn.

For example, the yarn forming the irregular plushed loops on the two sides is a textured polyester yarn whose titration in the ply is about 1.35 dtex (yarn count).

The numerical representation of the weave corresponding to the yarn forming the plushed loop is the following :

1
0
-
x
y in which x is 2, 3 or 4 and y is equal to x+1.

The present invention also concerns a method specially designed for the production of the aforesaid chain knitted fabric.

A large number of manufacturers and users employ the tightness notion in the rack, which is the quantity of yarn delivered by each loom roller in order to knit 480 rows of stitches. Measurement can be effected without stopping the loom.

In the case where the knitted fabric comprises a yarn forming a plushed loop effect, this is expressed by an increase of the quantity of yarn delivered. The length delivered of a yarn forming a plushed loop effect increases compared with the length delivered of the same yarn wich would not form the plushed loop effect.

The method of the invention comprises the steps of embodying a knitted fabric on a chain loom having at least two bars with broaches, one of the bars feeding a yarn for forming plushed loops and the other feeding a foundation yarn, and having a yield of the yarn forming the plushed loop 40 to 50% greater than the normal yield of a given yarn not for forming any plushed loop and a yield of the foundation yarn about 4 to 6% greater than the normal yield; and adjusting devices for forming the stitch so that the yarn for forming the plushed loop alternately and irregularly loops the right and wrong sides of the knitted fabric.

According to a preferred mode for implementing the method, the adjustment of the loom comprises of an abnormal adjustment of the positioning of the plate with respect to the needle during the stitch forming cycle with, ion consideration of the optimum adjustment for a flat knitted fabric, resulting in an increased crocheting and hemming depth. The hemming depth shall be increased by one third with respect to the normal adjustment; crocheting shall be increased by 10 to 40%. Secondly, the bar with the drawing-in hooks of the yarn forming the plushed loop shall be adjusted with respect to the corresponding needles so that the head of the needle is aligned with the upper part of the eye of the drawing-in hook. This adjustment usually is expressed by a specialist as one eye.

In the se of a double face ratined aspect type knitted fabric, used for producing a cloth the method according to the invention comprises, for example, the steps of embodying on the 3-bar chain loom a knitted fabric presenting the same yarn looping irregularly on the two sides with a yarn yield on the first bar corresponding to the looping yarn of from 40 to 50% more than the normal yield of a given yarn without any plushed loop effect, said yarn of the first bar consisting of a 54 dtex 40 ply textured polyester yarn and with a yarn yield on the third bar correspoding to the foundation yarn about 5% more than the normal yield; grinding with emery the knitted fabric thus obtained on the two sides; treating by vigorously agitating the emery-ground knitted, fabric in a humid environment; thermosetting the knitted fabric and possibly carrying out a swansdowning on the wrong side.

Preferably, the vigorous agitation treatment in a humid environment is carried out at the time when knitted fabric is dyed on a jet type closed circulation machine.

BRIEF DESCRIPTION OF THE DRAWINGS

The invention and its advantages and characteristics shall be more readily understood from a reading of the following description given by way of example for the production of a stitched double-faced knitted fabric with a ratined aspect and illustrated by the accompanying drawing in which.

DETAILED DESCRIPTION OF THE PREFERRED EMBODIMENTS

Figure 1:
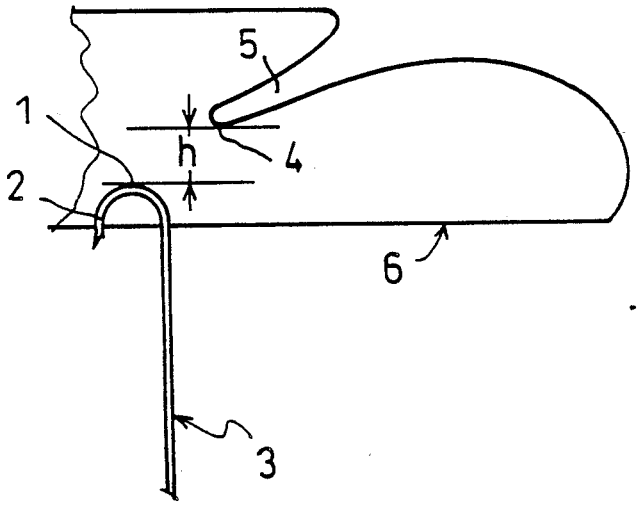
FIG. 1 is a profile view of a needle and a plate in the hemming position.
Figure 2:
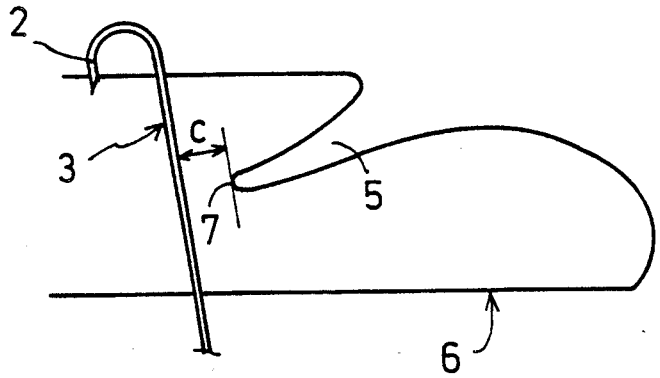
FIG. 2 is a profile view of a needle and a plate in the crocheting position.

In order to obtain a chain knitted fabric having on its two sides an irregular plushed loop effect effected with the same yarn, the adjustments of the chain loom are modified in the following conditions.

It is known that the hemming depth (h) is defined by the distance between the top 1 of the crochet 2 of the needle 3 at the time of hemming and the internal bottom 4 of the throat 5 of the plate 6. As regards the normal adjustment recommended by the manufacturer, the hemming depth is about 1.5 mm ; as regards the adjustment of the invention, this is about 2 mm. It is known that crocheting is defined as being the distance (c) between the back of the needle 3 at the time of crocheting and the bottom 7 of the throat 5. In normal adjustment, crocheting is about 1.5 to 1.8 mm, whereas in the adjustment of the invention it is about 2 mm.

The knitted fabric is embodied on a 3-bar chain loom. The numerical representation of the weave is as follows:

| I | II | III |
|---|---|---|
| 1 | 2 | 1 |
| 0 | 2 | 2 |
| — | — | — |
| 4 | 0 | 1 |
| 5 | 0 | 0 |

The yarn of the bar I is the yarn embodying the right side and wrong side plushed loop effect. The yarn of the bar III is the foundation yarn. In the present example, all the yarns are made of polyester. The yarn of bar I is a 54 dtex 40 ply yarn, the yarn of bar II a 100 dtex and the yarn of bar III a 50 dtex 16 ply yarn. The yarn of bar I is textured.

Figure 3:
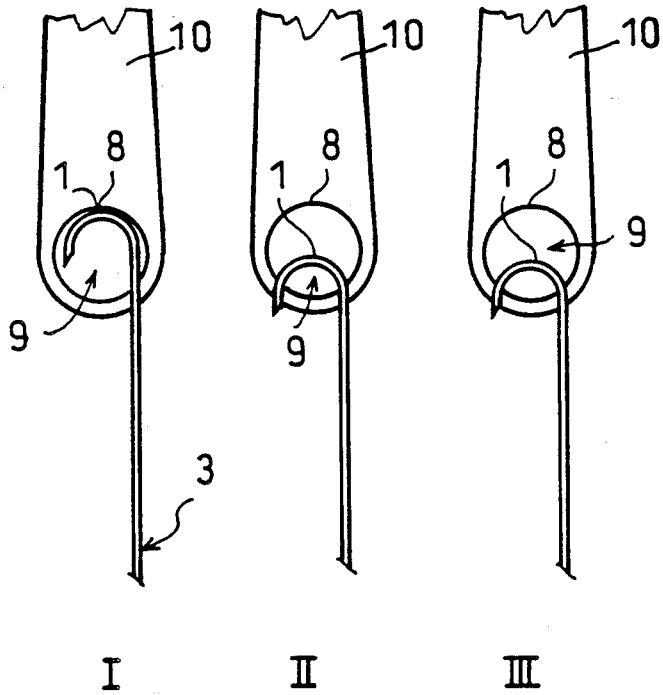
FIG. 3 shows the position of the needle with respect to the broaches for the three bars.

Adjustment of the three bars with broaches with respect to the needles at the time they are interlaced is shown on FIG. 3. Bar I has an adjustment of one eye, in other words the top 1 of the crochet 2 of the needle 3 is aligned with the upper bordering 8 of the heddle eye 9 of the broach 10. The bars II and III have an adjustment of half an eye, in other words the top 1 of the crochet 2 of the needle 3 is approximately centered with respect to the eye 9 of the broach 10.

As regards the yarn of the bar I, that is the yarn giving the plushed loop effect, tightening on the rack is 3.340 mm.

For the yarn of bar III, tightening on the rack is 1.060 mm, whereas normal adjustment is about 1.000 mm.

The density of stitches is 27 stitches/cm.

Adjustment of the loom, as recently described, provokes an excess feeding of the yarn of bar I on the two sides of the knitted fabric, which is made possible by reducing tighening of the foundation yarn. Thus, an irregular plushed loop effect is obtained from the yarn of bar I on both sides of the knitted fabric.

The knitted fabric obtained when removed from the loom then undergoes a grinding with emery treatment on its two sides. Preferably, this treatment should be effected firstly on the right side with light grinding with emery, and then on the wrong side with more vigorous grinding with emery.

Then the knitted fabric is dyed according to a conventional operating method without pretreating in a jet type machine. In this machine, the knitted fabric is propelled in a closed circuit in the dyeing bath and then is vigorously agitated in a humid environment which has the effect of fragmenting the filaments of the yarn of the plushed loops ground with emery. The knitted fabric is then thermoset by passing into a tenter.

The knitted fabric obtained presents on its two sides accumulation points of fibers giving it the aspect of a ratined woollen cloth. It has been observed that this aspect does dot deteriorate in usage, but on the other hand is retained despite constant usage and washing.

A range of knitted fabrics of this type of between 200 and 280 g/m$^2$ has been produced with on bar I a 54 dtex 40 ply textured polyester yarn whose tear strength is about 35 cN/tex, breaking elongation about 24%, curling about 40% and having a shrinkage at 200° C. of about 7%.

The invention is not limited to the embodiment example described above, but covers all variants. In particular, the weave given above may be modified, especially as regards the yarn of bar I, where it may, for example, be the following :

| I | or even | I |
|---|---|---|
| 1 | | 1 |
| 0 | | 0 |
| — | | — |
| 2 | | 4 |
| 3 | | 5 |

The double-faced knitted fabric with a ratined aspect is a particularly advantageous application of the invention, but the stitch knitted fabric, whose same sides, may certainly be implemented in other applications without departing from the context of the present invention.

What is claimed is:

1. Method for producing a knitted fabric of the type having a plushed loop effect, said method comprising: embodying a knitted fabric on a chain loom having at least two guide bars, one of said bars feeding a yarn for forming a plushed loop and the other said bar feeding a foundation yarn, with a yield of the yarn forming the plushed loop being 40 to 50% greater than a normal yield of the yarn which does not form any plushed loop and with a yield of the foundation yarn being about 4 to 6% greater than the normal yield, and adjusting devices of the loom for forming stiches so that the plushed loop forming yarn loops alternately and irregularly on face and back sides of the knitted fabric.

2. Method according to claim 1, wherein said adjustment of the loom comprises an abnormal adjustment of the positioning of a plate of the loom with respect to a plurality of needles during a stitch forming cycle, in consideration of the optimum adjustment for a flat knitted fabric, resulting in an increased hemming depth corresponding to stich length at the time of hemming as a distance between a top of a crochet of the needle and an internal bottom of a throat of the plate and an increased crocheting corresponding to lock-in at the time of crocheting as a distance between a back of the needle and the bottom of the throat of the plate.

3. Method according to claim 2, wherein the hemming depth is increased by about one third with respect to the normal adjustment and the crocheting is increased by 10 to 40%.

4. Method according to any of the claims 2 or 3, wherein the guide bar of the yarn forming the plushed loop is adjusted with respect to the needles so that the head of each of said needles is aligned with the upper part of a heddle eye of the guide bar.

5. Method according to claim 2 for production of a cloth of knitted fabric whose face and back sides have a ratined aspect, wherein said method comprises: embodying on a 3-bar chain loom a knitted fabric presenting a single yarn forming an irregular plushed loop on the face and back sides of the fabric with a yield of the yarn on a first bar of the loom correspondign to the yarn forming the plushed loop being 40 to 50% greater than a normal yield of the yarn without any plushed loop formation, said yarn consisting of a 54 dtex 40 ply textured polyester yarn, with a yarn yield on a third bar of the loom corresponding to a foundation yarn being about 5% greater than the normal yield; grinding with emergy the knitted fabric thus obtained on both of the face and back sides; treating by vigorously agitating the emery-ground knitted fabric in a humid environment, and finally thermosetting the knitted fabric.

6. Method according to claim 5, wherein said treatment in the humid environment comprises: dyeing the knitted fabric on a jet type closed circulation machine.

7. A method for producing a knitted fabric having a plushed loop effect, comprising the steps of embodying a knitted fabric on a chain loom having at least two guide bars, one of said bars for feeding a yarn of forming a plushed loop and another said bar for feeding a foundation yarn, whereby providing a yield of the yarn forming the plushed loop 40 to 50% greater than a normal yield of the same yarn which would not form any plushed loop and a yield of the foundation yarn about 4 to 6% greater than the normal yield; and adjusting a device of the loom for forming a stitch so that the yarn of forming the plushed loop alternately and irregularly loops on both of face and back sides of the knitted fabric.

8. A method for producing a cloth of knitted fabric having a ratined effect on both face and back sides of the clotch comprising the steps of embodying a knitted fabric on a chain loom having three guide bars; presenting a yarn of forming an irregularly plushed loop on the face and back sides of the fabric on a first bar of the loom to create a yarn yield of 40 to 50% greater than a normal yield of the same yarn which would not form any plushed loop, a yarn of normally knitting on a second bar of the loom having the normal yarn yield and a foundation yarn on a third bar of the loom having a yarn yield of about 5% greater than the normal yield, wherein said yarn on the first bar is a 54 dtex 40 polyester yarn, 100 dtex on the second bar and 50 dtex 16 on the third bar; adjusting three croshet needles with respect to heddle eyes of said bars; grinding with emery the knitted fabric thus obtained on the face and back sides; treating by vigorously agitating the emery-ground knitted fabric in a humid environment, and finally thermosetting the knitted fabric.

9. Method for producing a cloth of knitted fabric according to claim 8, wherein said adjustment is made by aligning the top of the crochet hook of a first needle with the upper bordering of the heddle eye of the first bar and aligning the tops of the crochet hooks of a second and a third needle with the centers of the heddle eyes of said second and third bar.

* * * * *